United States Patent [19]

Senor

[11] Patent Number: 4,784,622

[45] Date of Patent: Nov. 15, 1988

[54] STAMPED AND FORMED CONTACT

[75] Inventor: Ronald Senor, N. Attleboro, Mass.

[73] Assignee: Augat Inc., Attleboro, Mass.

[21] Appl. No.: 79,765

[22] Filed: Jul. 29, 1987

[51] Int. Cl.[4] ..... H01R 13/11

[52] U.S. Cl. ..... 439/853

[58] Field of Search ..... 439/81, 82, 834, 842, 439/851, 852, 853

[56] References Cited

U.S. PATENT DOCUMENTS 3,348,192 10/1967 DeVito ..... 439/853

*Primary Examiner*—Joseph H. McGlynn

*Attorney, Agent, or Firm*—Weingarten, Schurgin, Gagnebin & Hayes

[57] ABSTRACT

An electronic component contact which provides substantially lower insertion force while providing sufficient contact force to maintain good electrical engagement with a component lead. The contact includes a plurality of inwardly angled spring fingers which are laterally yieldable and which are of two or more different lengths. A component lead inserted into the contact initially engages the shorter spring fingers and thereafter engages the longer spring fingers, the sequential engagement of the spring fingers with the inserted lead providing substantially reduced insetion force. Once the lead is inserted into the improved contact, the normal contact forces of the fingers on the lead are sufficient to maintain good electrical engagement.

8 Claims, 1 Drawing Sheet

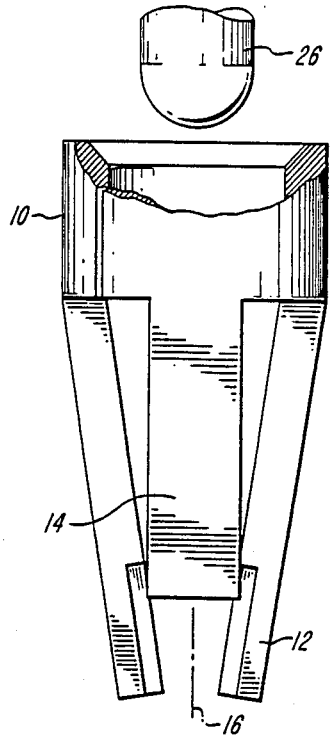
FIG. 1
FIG. 2
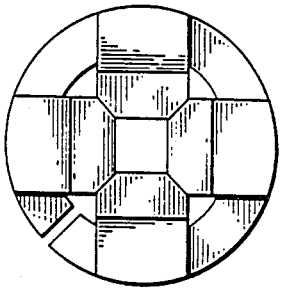
FIG. 3
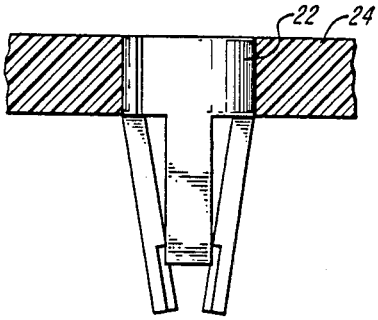
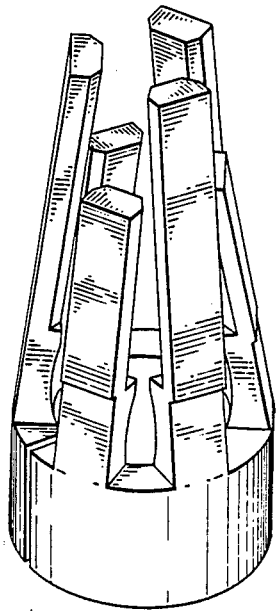
FIG. 4

STAMPED AND FORMED CONTACT

FIELD OF THE INVENTION

This invention relates to electrical contacts and more particularly to a contact having resilient spring fingers and reduced insertion and withdrawal forces.

BACKGROUND OF THE INVENTION

Electrical contacts for retaining the leads of electrical components must have sufficient contact force to retain engagement with the component leads and yet be small enough to allow easy insertion and withdrawal of the component leads without damage to the leads, the contacts or the component. In general the techniques employed heretofore to reduce the insertion force on an electronic component have related to a multiple contact socket in which an array of contacts are configured to minimize insertion force. One type of low insertion force socket employs an array of contacts which are moved to an open position for acceptance of a component plugged therein, and after component insertion the contacts are moved to a closed position for electrical engagement with the component leads. Another type of low insertion force socket employs an array of contacts which are arranged in spaced planes such that component leads inserted into the socket engage the group of contacts in the upper plane before the engagement of contacts in the lower plane. The individual contacts themselves do not have any improved configuration for minimizing insertion force.

SUMMARY OF THE INVENTION

The present invention provides an electronic component contact which provides substantially lower insertion force while providing sufficient contact force to maintain good electrical engagement with a component lead. The contact, in accordance with the invention, includes a plurality of inwardly angled spring fingers which are laterally yieldable and which are of two or more different lengths. A component lead inserted into the contact initially engages the shorter spring fingers and thereafter engages the longer spring fingers, the sequential engagement of the spring fingers with the inserted lead providing substantially reduced insertion force. Once the lead is inserted into the improved contact, the normal contact forces of the fingers on the lead are sufficient to maintain good electrical engagement. The normal force of the fingers can be determined by the thickness of the fingers and the finger length. The withdrawal force can also be related by proper configuration of the beams. The contact is typically retained in a plated hole of a circuit board or in a socket body. Alternatively, the contact can be retained within a conductive sleeve of a contact element which itself is then mounted in a socket body, circuit board or other mounting member. The improved contact can be employed in a socket of otherwise conventional configuration and can also be employed in a socket having spaced planes each containing a group of contacts, thereby to further reduce the insertion force on a component inserted therein.

DESCRIPTION OF THE DRAWINGS

The invention will be more fully understood from the following detailed description taken in conjunction with the accompanying drawings in which:

FIG. 1 is a partly cut away elevation view of a contact in accordance with the invention;

FIG. 2 is an end view of the contact of FIG. 1;

FIG. 3 is a cutaway elevation view showing the contact in a mounting opening; and FIG. 4 is a pictorial view of an alternative contact embodiment.

DETAILED DESCRIPTION OF THE INVENTION

Referring to the drawing, a contact embodying the principles of the invention is shown and comprises a ring portion 10 and a plurality of spring fingers 12 and 14 outwardly extending therefrom and each being angularly disposed inward toward a longitudinal axis 16 of the contact. The contact is fabricated by stamping and forming steps per se known in the art from a suitable metal such as beryllium copper, phosphor bronze or other spring alloy. The fingers or beams 12 are longer than the beams 14 and provide staggered engagement of a component lead 26 during insertion of the lead into the contact. In the illustrated embodiment, four beams are shown in FIG. 2, two of longer length, and two of shorter length in alternating disposition. Six beams are shown in FIG. 4, having alternating short and long beams. It will be appreciated that the number of beams can vary to suit the specific implementation requirements, such as the intended insertion force and withdrawal force and the configuration of the component lead to be accommodated.

The contact is mounted within an opening 22 of a mounting member 24 (FIG. 3) which can be a plated hole of a circuit board or a socket body. An array of like contacts is provided in the mounting member to accommodate the multiple leads of an electronic component, such as an integrated circuit. Alternatively, the contact can be disposed within a conductive sleeve of a contact element, which element can itself then be mounted in a mounting member such as a socket body or circuit board.

During insertion of a component lead 26, the lead first engages the shorter beams 14 and thereafter engages the longer beams 12. The engaging force is sequential and, as a result, the insertion force on the lead is reduced in relation to the insertion force on a conventional contact where the beams are all of equal length. Typically, a reduction in insertion force of 30 to 40 percent is achievable in accordance with the novel contact configuration. The withdrawal force is dependent on beam characteristics, length, cross-section and elasticity, and can be tailored to provide an intended force which can be the same as or different than that of conventional equal beam length construction.

The normal force of engagement between the installed lead and beams remains sufficient for good electrical contact. The normal force can be determined by the length and thickness of the beams in combination with the spring characteristics of the beam material.

The invention is not to be limited by what has been particularly shown and described, except as indicated in the appended claims.

What is claimed is:

1. An electrical contact providing a reduced, two-step insertion force for a component lead inserted therein, comprising:

a ring portion defining an entrance end;

a longitudinal axis extending symmetrically through said ring portion;

a first plurality of resilient beams formed integral with and outwardly disposed from the ring portion and tapered inward toward said longitudinal axis extending symmetrically through the ring portion, said first plurality of beams being of a first length and formed symmetrically about said ring portion; and a second plurality of resilient beams of a length shorter than the length of said first plurality of beams formed integral with and outwardly extending from the ring portion and tapering toward said longitudinal axis, said second plurality of beams being formed symmetrically about said ring portion, said first and second plurality of resilient beams formed about said ring portion in an staggered symmetrical arrangement of first and second resilient beams wherein the component lead is insertable therein with reduced, two-step normal insertion force, initially engaging said first plurality of resilient beams and subsequently engaging said second plurality of resilient beams, and wherein said first plurality of beams and said second plurality of beams are independently formed with respect to one another.

2. The electrical contact of claim 1 wherein said first plurality of beams and said second plurality of beams are independently formed with respect to one another about said ring portion in in said staggered symmetrical arrangement.

3. The electrical contact of claim 2 wherein the ring portion is configured to be retained within an opening of a mounting member.

4. The electrical contact of claim 1 wherein the ring portion is stamped and formed from an electrically conductive spring material and wherein said first and second plurality of beams are stamped and formed independently with respect to one another from said electrically conductive spring material.

5. The electrical contact of claim 4 wherein the material is beryllium copper.

6. The electrical contact of claim 4 wherein the material is phosphor bronze.

7. The electrical contact of claim 4 wherein said first and second plurality are each two.

8. The electrical contact of claim 4 wherein said first and second plurality are each three.

* * * * *